US005231421A

United States Patent [19]

Yoshida et al.

[11] Patent Number: 5,231,421

[45] Date of Patent: Jul. 27, 1993

[54] THERMAL TRANSFER RECORDING APPARATUS WITH DELAYED DRIVING

[75] Inventors: Takehiro Yoshida, Tokyo; Takeshi Ono, Yokohama; Makoto Kobayashi, Tama; Tomoyuki Takeda, Yokohama; Satoshi Wada, Kawasaki; Minoru Yokoyama; Takashi Awai, both of Yokohama; Yasushi Ishida, Tokyo; Akihiro Tomoda; Masakatsu Yamada, both of Yokohama, all of Japan

[73] Assignee: Canon Kabushiki Kaisha, Tokyo, Japan

[21] Appl. No.: 824,874

[22] Filed: Jan. 22, 1992

Related U.S. Application Data

[63] Continuation of Ser. No. 558,482, Jul. 27, 1990, abandoned.

[30] Foreign Application Priority Data

Jul. 31, 1989 [JP] Japan ..... 1-198270

[51] Int. Cl.[5] ..... B41J 2/325

[52] U.S. Cl. ..... 346/76 PH

[58] Field of Search ..... 346/76 PH, 1.1; 400/902

[56] References Cited

U.S. PATENT DOCUMENTS

| | | | |
|---|---|---|---|
| 4,456,392 | 6/1984 | Nozaki et al. | 400/120 |
| 4,463,359 | 7/1984 | Ayata et al. | 346/1.1 |
| 4,496,891 | 1/1985 | Kobayashi | 318/696 |
| 4,520,373 | 5/1985 | Ayata et al. | 346/140 R |
| 4,636,810 | 1/1987 | Asakura et al. | 346/76 PH |
| 4,724,447 | 2/1988 | Oda | 346/76 PH |
| 4,814,789 | 3/1989 | Ono | 346/76 PH |
| 5,001,410 | 3/1991 | Ono | 318/696 |
| 5,008,607 | 4/1991 | Ono et al. | 318/696 |

FOREIGN PATENT DOCUMENTS

| | | | |
|---|---|---|---|
| 0095177 | 6/1984 | Japan . | |
| 0094360 | 4/1987 | Japan | 346/76 PH |
| 0219119 | 4/1987 | Japan . | |
| 0295953 | 12/1988 | Japan . | |

OTHER PUBLICATIONS

Eur. Pat. Off. Search Rep. for Eur. Pat. Appln. No. 90114599.5.

*Primary Examiner*—Benjamin R. Fuller
*Assistant Examiner*—N. Le
*Attorney, Agent, or Firm*—Fitzpatrick, Cella, Harper & Scinto

[57] ABSTRACT

A thermal transfer recording apparatus for transferring the ink of an ink sheet to a recording medium to thereby effect the recording of images on the recording medium has a first motor for conveying the ink sheet, a second motor for conveying the recording medium, recording means for acting on the ink sheet to effect the recording of images on the recording medium, time counting means for counting a predetermined time after the phase change of the first and second motors, and control means for controlling the recording means so as to be driven after the lapse of the predetermined time after the phases of the first and second motors are changed.

18 Claims, 12 Drawing Sheets

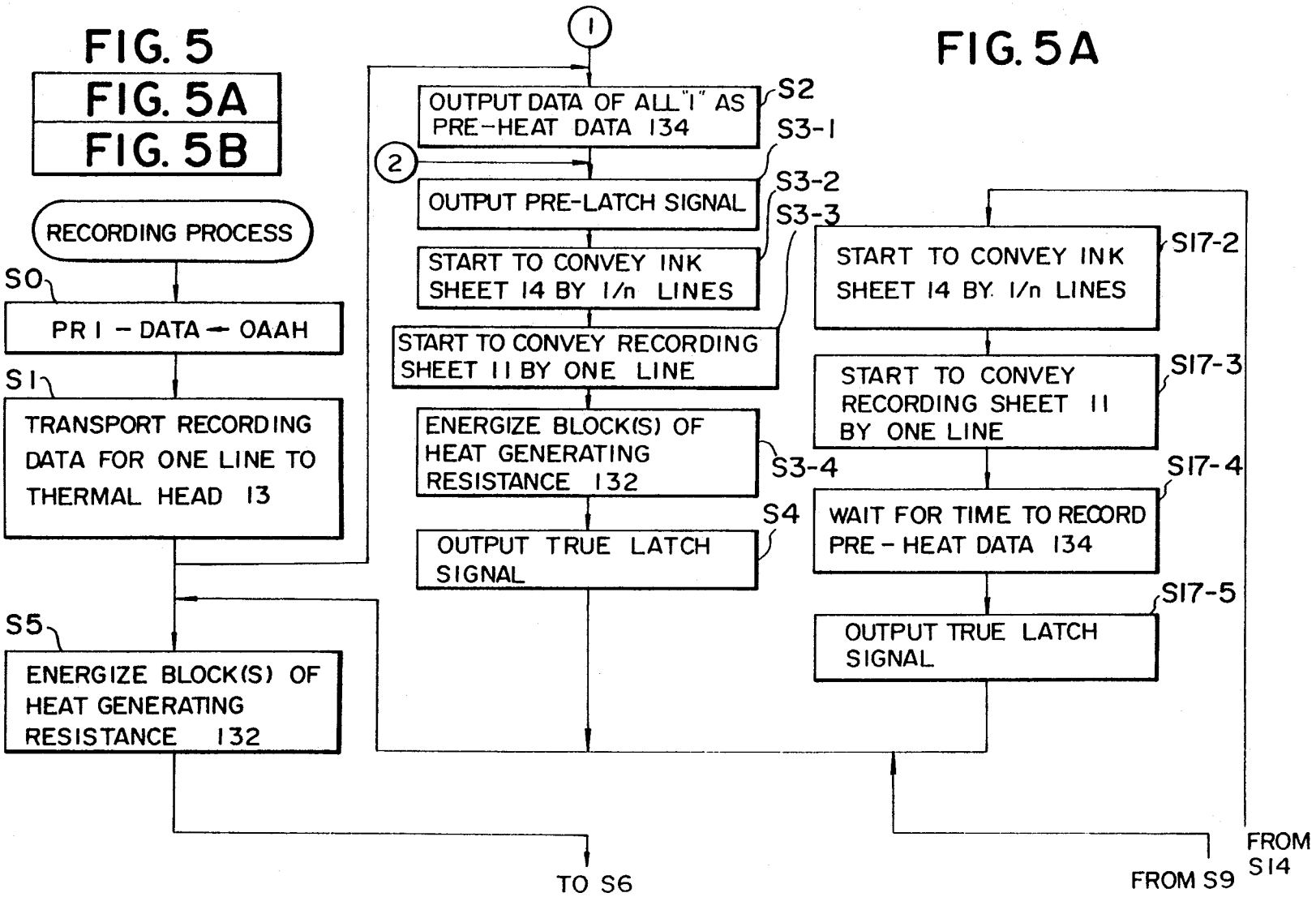
FIG. 5
FIG. 5A
FIG. 5B
RECORDING PROCESS
S0
PR I - DATA — OAAH
S1
TRANSPORT RECORDING DATA FOR ONE LINE TO THERMAL HEAD 13
S5
ENERGIZE BLOCK(S) OF HEAT GENERATING RESISTANCE 132
TO S6
1
2
S2
OUTPUT DATA OF ALL "1" AS PRE-HEAT DATA 134
S3-1
OUTPUT PRE-LATCH SIGNAL
S3-2
S3-3
START TO CONVEY INK SHEET 14 BY 1/n LINES
START TO CONVEY RECORDING SHEET 11 BY ONE LINE
S3-4
ENERGIZE BLOCK(S) OF HEAT GENERATING RESISTANCE 132
S4
OUTPUT TRUE LATCH SIGNAL
FIG. 5A
S17-2
START TO CONVEY INK SHEET 14 BY 1/n LINES
S17-3
START TO CONVEY RECORDING SHEET 11 BY ONE LINE
S17-4
WAIT FOR TIME TO RECORD PRE-HEAT DATA 134
S17-5
OUTPUT TRUE LATCH SIGNAL
FROM S14
FROM S9

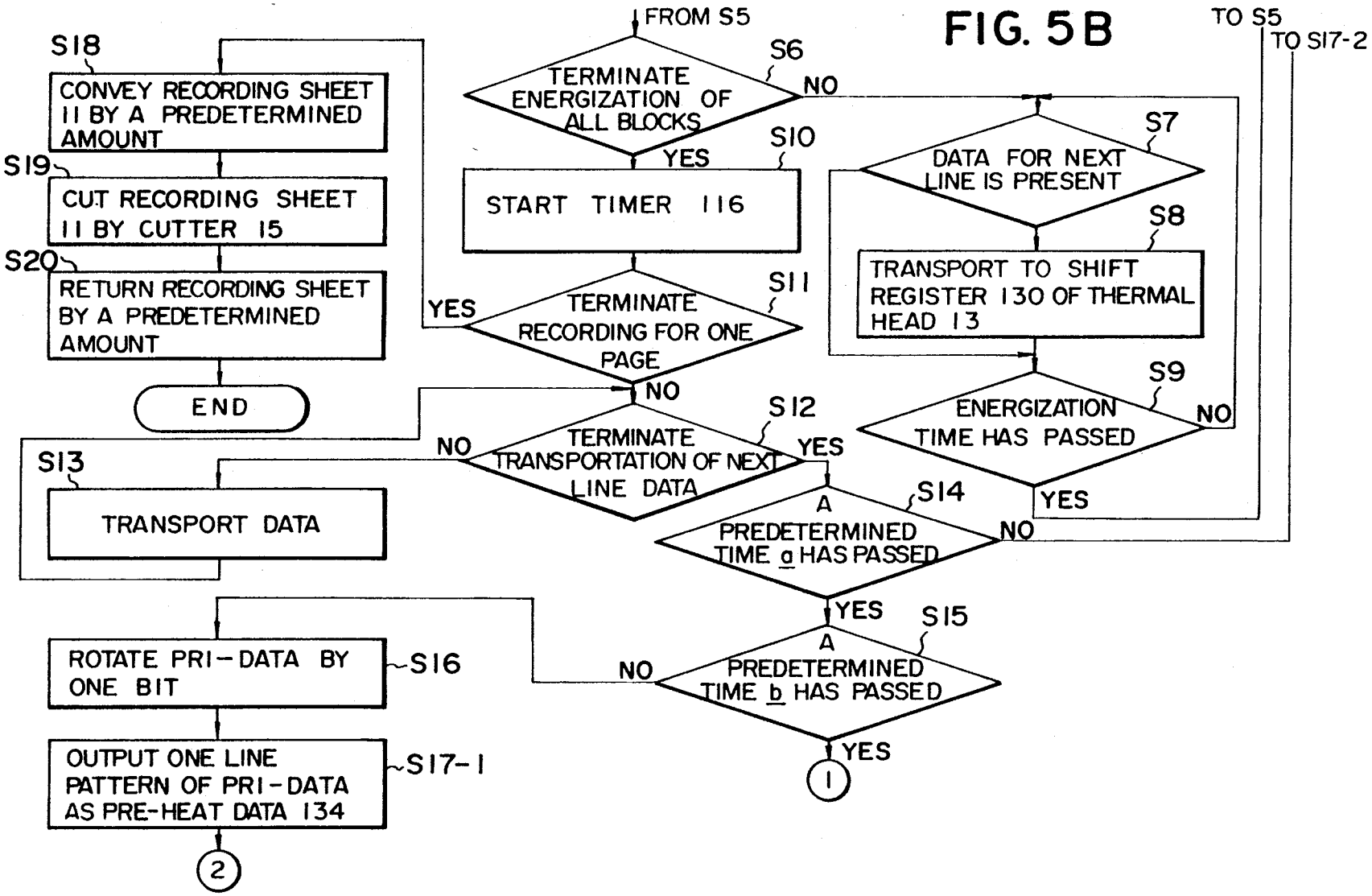
FIG. 5B
FROM S5
TO S5
TO S17-2
S6
TERMINATE ENERGIZATION OF ALL BLOCKS
NO
YES
S10
START TIMER 116
S11
TERMINATE RECORDING FOR ONE PAGE
YES
NO
S12
TERMINATE TRANSPORTATION OF NEXT LINE DATA
YES
NO
S7
DATA FOR NEXT LINE IS PRESENT
S8
TRANSPORT TO SHIFT REGISTER 130 OF THERMAL HEAD 13
S9
ENERGIZATION TIME HAS PASSED
NO
YES
S14
A PREDETERMINED TIME a HAS PASSED
NO
YES
S15
A PREDETERMINED TIME b HAS PASSED
NO
YES
1
S18
CONVEY RECORDING SHEET 11 BY A PREDETERMINED AMOUNT
S19
CUT RECORDING SHEET 11 BY CUTTER 15
S20
RETURN RECORDING SHEET BY A PREDETERMINED AMOUNT
END
S13
TRANSPORT DATA
S16
ROTATE PRI-DATA BY ONE BIT
S17-1
OUTPUT ONE LINE PATTERN OF PRI-DATA AS PRE-HEAT DATA 134
2

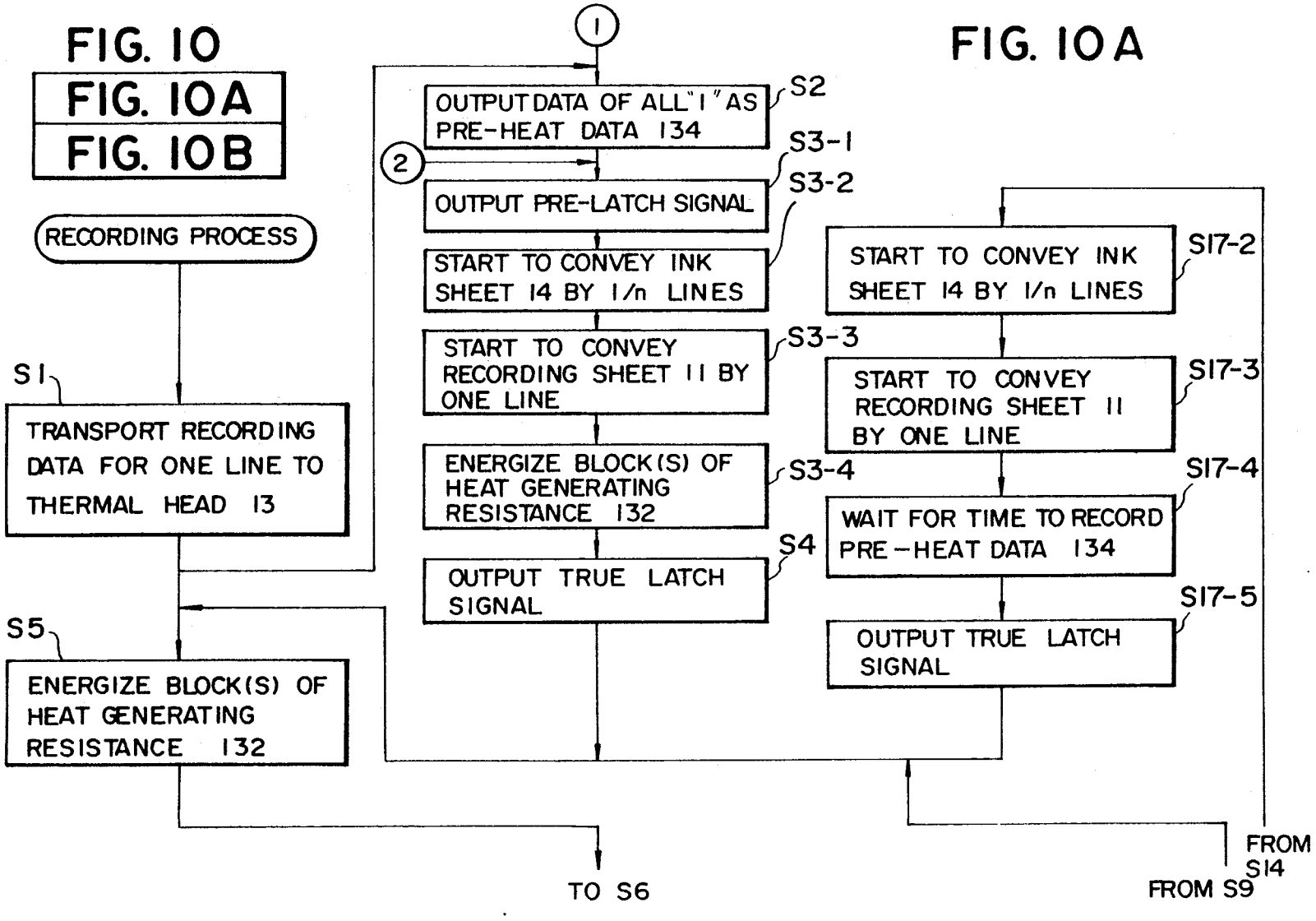
FIG. 10
FIG. 10A
FIG. 10B
RECORDING PROCESS
S1
TRANSPORT RECORDING DATA FOR ONE LINE TO THERMAL HEAD 13
S5
ENERGIZE BLOCK(S) OF HEAT GENERATING RESISTANCE 132
TO S6
1
2
S2
OUTPUT DATA OF ALL "1" AS PRE-HEAT DATA 134
S3-1
OUTPUT PRE-LATCH SIGNAL
S3-2
START TO CONVEY INK SHEET 14 BY 1/n LINES
S3-3
START TO CONVEY RECORDING SHEET 11 BY ONE LINE
S3-4
ENERGIZE BLOCK(S) OF HEAT GENERATING RESISTANCE 132
S4
OUTPUT TRUE LATCH SIGNAL
S17-2
START TO CONVEY INK SHEET 14 BY 1/n LINES
S17-3
START TO CONVEY RECORDING SHEET 11 BY ONE LINE
S17-4
WAIT FOR TIME TO RECORD PRE-HEAT DATA 134
S17-5
OUTPUT TRUE LATCH SIGNAL
FROM S14
FROM S9

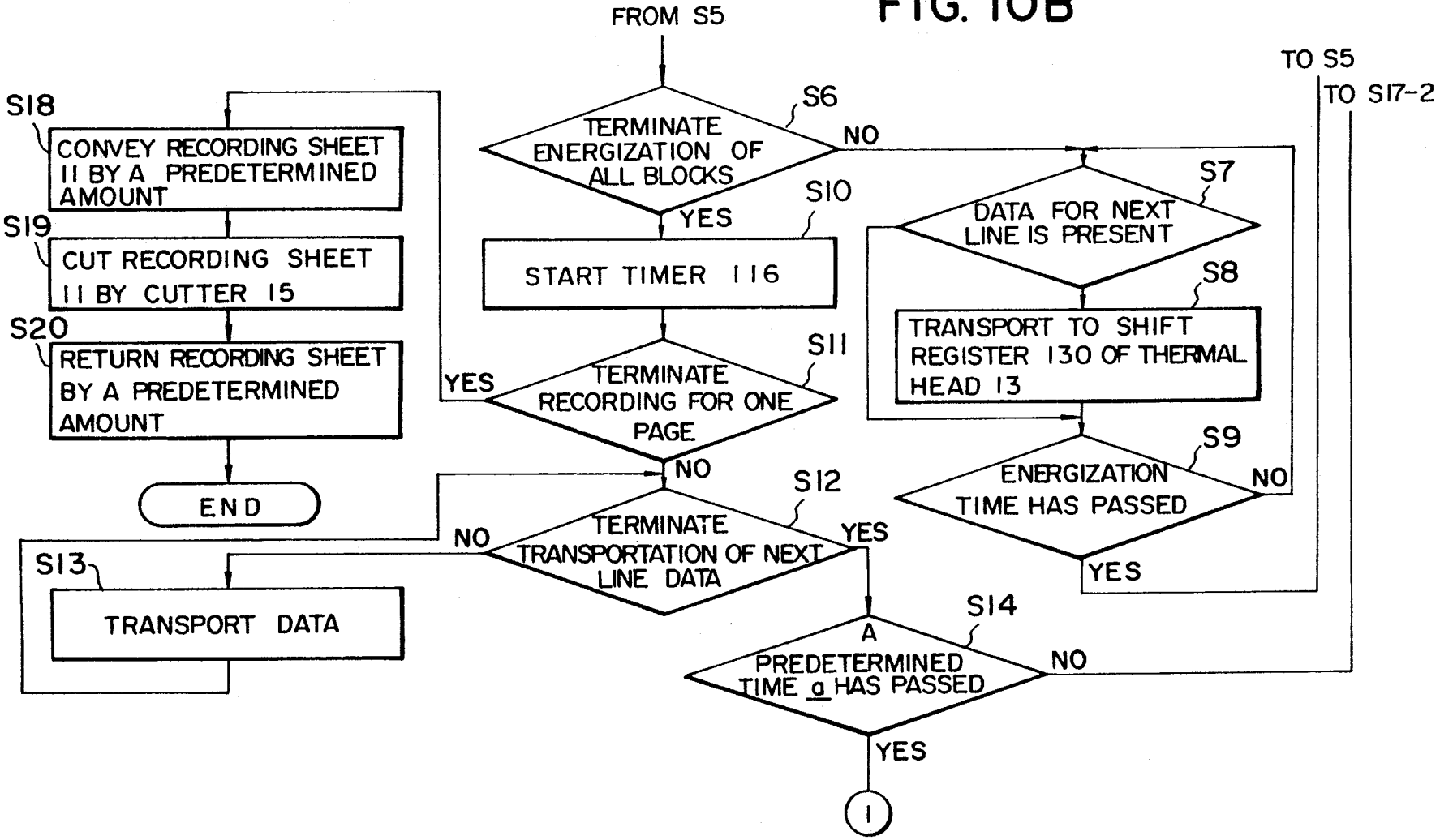
FIG. 10B
FROM S5
S6
TERMINATE ENERGIZATION OF ALL BLOCKS
NO
YES
S10
START TIMER 116
S11
TERMINATE RECORDING FOR ONE PAGE
YES
NO
S12
TERMINATE TRANSPORTATION OF NEXT LINE DATA
YES
NO
S7
DATA FOR NEXT LINE IS PRESENT
S8
TRANSPORT TO SHIFT REGISTER 130 OF THERMAL HEAD 13
S9
ENERGIZATION TIME HAS PASSED
NO
YES
S14
PREDETERMINED TIME a HAS PASSED
NO
YES
A
1
TO S5
TO S17-2
S18
CONVEY RECORDING SHEET 11 BY A PREDETERMINED AMOUNT
S19
CUT RECORDING SHEET 11 BY CUTTER 15
S20
RETURN RECORDING SHEET BY A PREDETERMINED AMOUNT
END
S13
TRANSPORT DATA

THERMAL TRANSFER RECORDING APPARATUS WITH DELAYED DRIVING

This application is a continuation of application Ser. No. 07/558,462 filed Jul. 27, 1990, now abandoned.

BACKGROUND OF THE INVENTION

1. Field of the Invention

This invention relates to a heat transfer recording apparatus and a facsimile apparatus for transferring the ink of an ink sheet to a recording medium to thereby effect the recording of images on the recording medium.

The term "heat transfer recording apparatus" used herein covers, besides a facsimile apparatus, for example, what assumes the form of an electronic typewriter, a copying apparatus and a printer.

2. Related Background Art

Generally, a heat transfer printer uses an ink sheet comprising base film having heat-meltable (or heat-sublimating) ink applied thereto, selectively heats the ink sheet correspondingly to an image signal by a thermal head, and transfers the melted (or sublimated) ink to a recording sheet to thereby accomplish image recording. Generally, this ink sheet is one from which the ink is completely transferred to a recording sheet by one time image recording (a so-called one-time ink sheet) and therefore, it has been necessary that after the termination of the recording of one character or one line, the ink sheet be conveyed by an amount corresponding to the recorded length, and then the unused portion of the ink sheet be reliably brought to the recording position. This has increased the quantity of ink sheet used, and as compared with an ordinary thermosensitive printer for recording images on thermosensitive paper, the heat transfer printer has suffered from the tendency of its running cost becoming higher.

In order to solve such a problem, there has been proposed a heat transfer printer in which as seen in U.S. Pat. No. 4,456,392, Japanese Laid-Open Patent Application No. 58-201686 and Japanese Patent Publication No. 62-58917, a recording sheet and an ink sheet are conveyed with a velocity difference therebetween. As described in these publications, there is known an ink sheet capable of plural (m) times of image recording (a so-called multiprint sheet). If such ink sheet is used, when recording is to be continuously effected over a recording length L, recording can be accomplished with the length of the ink sheet conveyed after or during the recording of each image being made smaller than the length L ($L/n:n>1$). Thereby, the efficiency of use of the ink sheet becomes n times as great as that before, and a reduction in the running cost of the heat transfer printer can be expected. This recording system will hereinafter be referred to as multiprint.

In the case of multiprint using such an ink sheet, the ink of the ink layer of the ink sheet is heated n times. During each cycle of heating, a shearing force is produced between that portion of the ink of the ink layer which has been melted (or sublimated) and that portion of the ink which is not melted (or sublimated) to thereby transfer the ink to the recording sheet. This has led to the problem that for example, even when true recording is effected with the recording sheet and the ink sheet being stationary, the ink of the ink sheet may not sufficiently be transferred to the recording sheet.

SUMMARY OF THE INVENTION

It is an object of the present invention to provide a heat transfer recording apparatus and a facsimile apparatus which can markedly improve the quality of an image.

It is another object of the present invention to provide a heat transfer recording apparatus and a facsimile apparatus which can effect recording with an ink sheet and a recording medium being reliably moved.

It is still another object of the present invention to provide a heat transfer recording apparatus and a facsimile apparatus in which the quantity of ink sheet consumed can be decreased.

It is yet another object of the present invention to provide a heat transfer recording apparatus and a facsimile apparatus which, in view of the aforedescribed example of the prior art, can effect true recording with an ink sheet and a recording medium having actually started movement after the phase change of motors for conveying the ink sheet and the recording medium, respectively, is effected.

BRIEF DESCRIPTION OF THE DRAWINGS

FIGS. 5A and 5B are a flow chart showing the recording process of the embodiment.

FIGS. 10A and 10B are a flow-chart showing the recording process of another embodiment of the present invention.

DESCRIPTION OF THE PREFERRED EMBODIMENTS

Some preferred embodiments of the present invention will hereinafter be described in detail with a facsimile apparatus used taken as an example.

The embodiment which will first be described hereinafter is operated so that recording means may be made to generate heat after the lapse of a predetermined time after the phases of motors for conveying a recording medium and an ink sheet, respectively, are changed. Thus, according to this embodiment, melted or sublimated ink rubs against the recording medium to thereby effect transfer and therefore, efficient transfer becomes possible.

Description of a Facsimile Apparatus (FIGS. 1–4)

Figure 1:
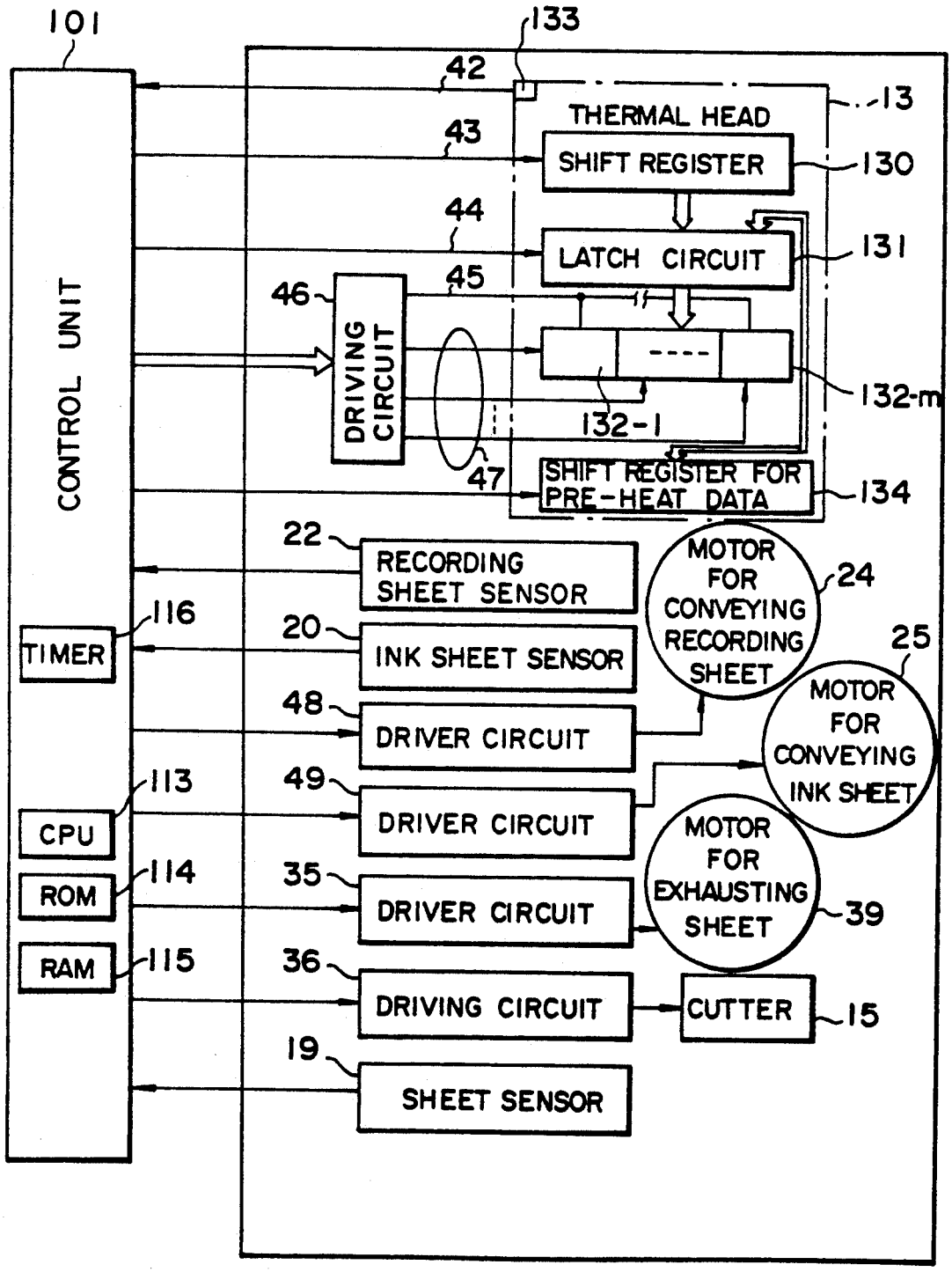
FIG. 1 shows electrical connections between a control unit and a recording unit in an embodiment of the present invention.
Figure 2:
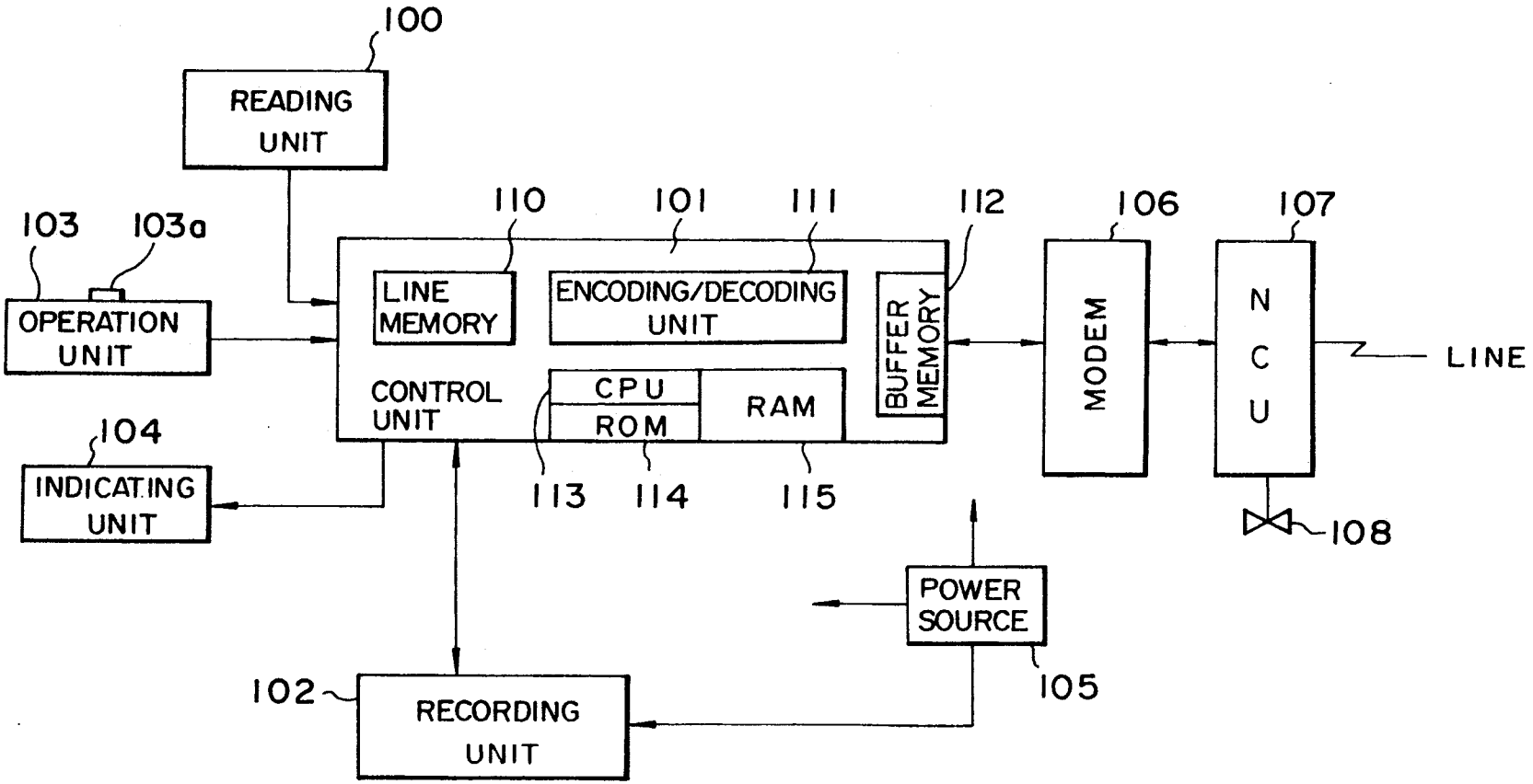
FIG. 2 is a block diagram schematically showing the construction of a facsimile apparatus according to an embodiment of the present invention.
Figure 3A:
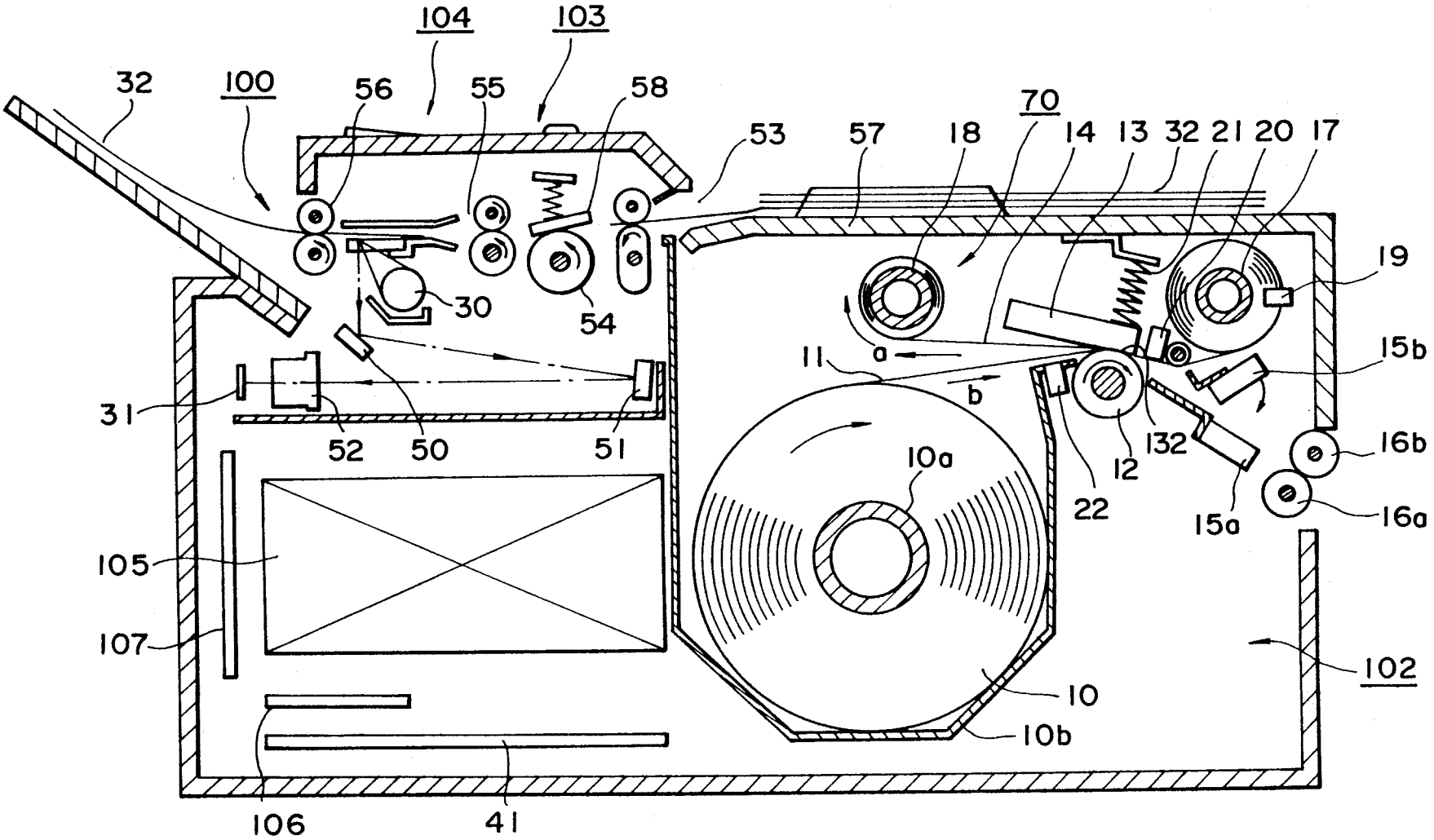
FIG. 3A is a side sectional view showing the mechanism portion of the facsimile apparatus according to the embodiment.
Figure 3B:
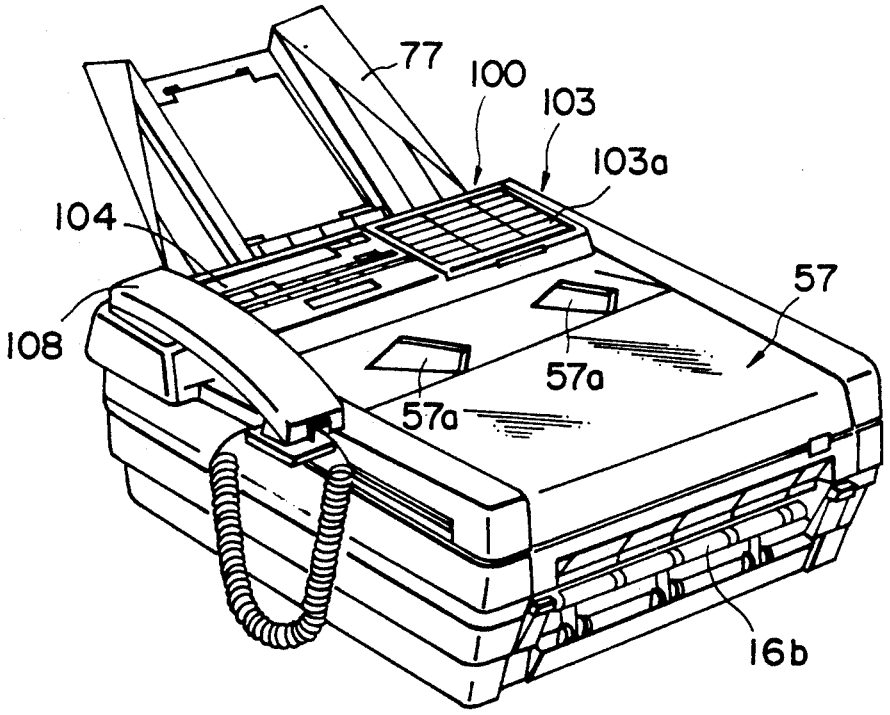
FIG. 3B is a pictorial perspective view of the facsimile apparatus.
Figure 4:
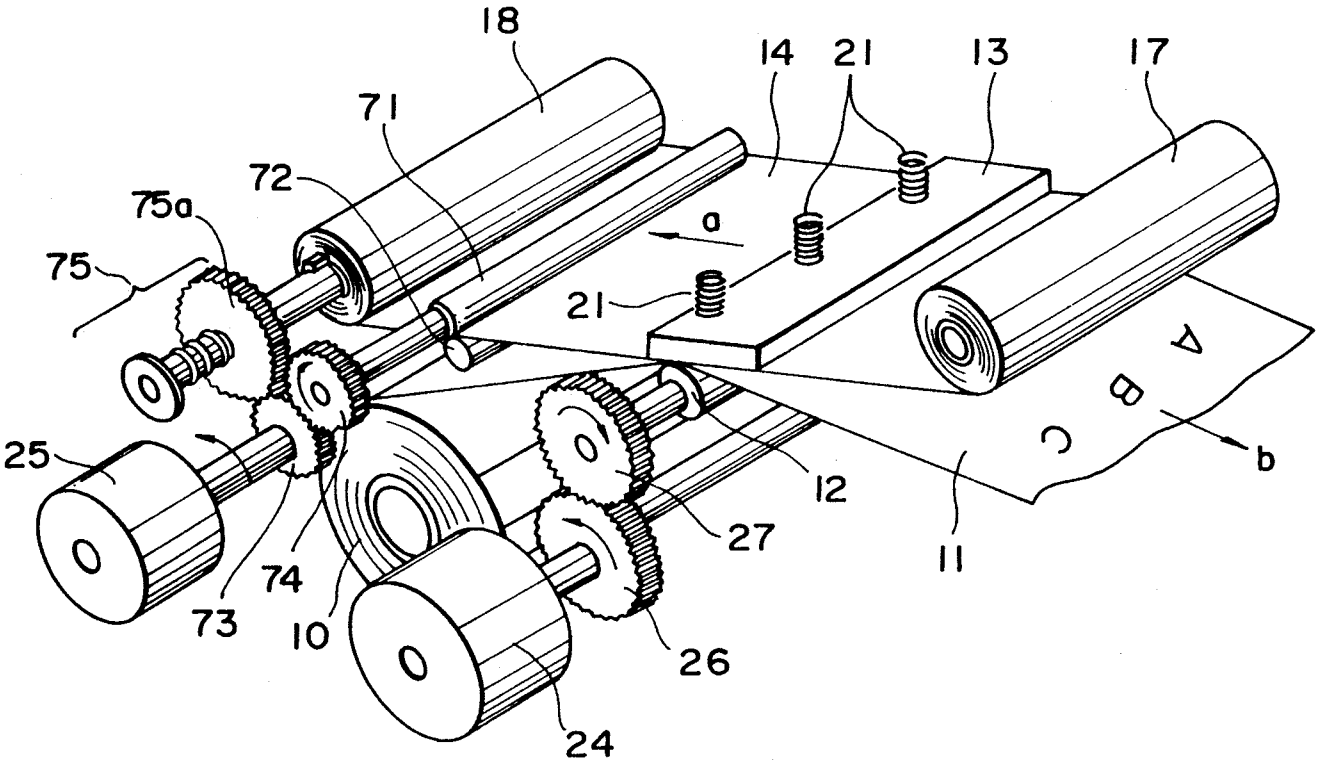
FIG. 4 shows the structure of conveying systems for an ink sheet and a recording sheet.

FIGS. 1 through 4 show an embodiment of the present invention as it is applied to a facsimile apparatus. FIG. 1 shows electrical connections between the control unit 101 and recording unit 102 of the facsimile apparatus, FIG. 2 is a block diagram schematically showing the construction of the facsimile apparatus, FIG. 3A is a side sectional view of the facsimile apparatus, FIG. 3B is a pictorial perspective view of the facsimile apparatus, and FIG. 4 shows conveying mechanisms for the recording sheet and the ink sheet.

The construction of the facsimile apparatus will first be described briefly with reference to FIG. 2.

In FIG. 2, the reference numeral 100 designates a reading unit for photoelectrically reading an original and outputting it as a digital image signal to a control unit 101. The recording unit 100 is provided with an original conveying motor, a CCD image sensor, etc. The construction of the control unit 101 will now be described. The reference numeral 110 denotes a line memory storing therein the image data of each line of image data. During the transmission or copying of the original, image data corresponding to one line from the reading unit 100 is stored in the line memory 110, and during the reception of image data, one line data of decoded received image data is stored in the line memory 110. The stored data is output to a recording unit 102, whereby image recording is effected. The reference numeral 111 designates an encoding/decoding unit for encoding transmitted image information by MH encoding or the like and decoding the received encoded image data and converting it into image data. The reference numeral 112 denotes a buffer memory storing the transmitted or received encoded image data therein. These various portions of the control unit 101 are controlled, for example, by a CPU 113 such as a microprocessor. The control unit 101 is provided with not only the CPU 113, but also with a ROM 114 storing therein the control program of the CPU 113 and various data, and a RAM 115 for temporarily preserving various data as the work area of the CPU 113.

The reference numeral 102 designates a recording unit provided with a thermal line head (provided with heat generating elements over the full recording width) for effecting image recording on a recording sheet by the heat transfer recording method. The construction of this unit will be described later in detail with reference to FIG. 3. The reference numeral 103 denotes an operation unit including a key for indicating various functions such as transmission starting, a telephone number input key, etc., and the reference character 103*a* designates a switch for indicating the kind of the ink sheet 14. When the switch 103*a* is ON, it indicates that a multiprint ink sheet is mounted, and when the switch 103*a* is OFF, it indicates that an ordinary ink sheet (so-called one-time ink sheet) is mounted. The reference numeral 104 denotes an indicating unit usually disposed adjacent to the operation unit 103 for indicating various functions and the state or the like of the apparatus. The reference numeral 105 designates a power source unit for supplying electric power to the entire apparatus. The reference numeral 106 denotes a modem (modemodulator), the reference numeral 107 designates a net control unit (NCU), and the reference numeral 108 denotes a telephone set.

The construction of the recording unit 102 will now be described in detail with reference to FIG. 3A. In FIG. 3A, portions common to those in FIG. 2 are given identical reference numerals.

In FIG. 3A, the reference numeral 10 designates a roll of paper comprising a recording sheet 11 which is plain paper wound into the shape of a roll on a core 10*a*. This roll of paper 10 is rotatably contained in the apparatus so that the recording sheet 11 can be supplied to the thermal head 13 by the rotation of a platen roller 12 in the direction of arrow. Denoted by 10*b* is a roll-of-paper loading portion which is removably loaded with the roll of paper 10. The platen roller 12 serves to convey the recording sheet 11 in the direction of arrow b and press the ink sheet 14 and the recording sheet 11 between it and the heat generating member 132 of the thermal head 13. The recording sheet 11, to which the ink of the ink sheet 14 is transferred by the heat generation of the thermal head 13 to thereby effect image recording, is conveyed toward discharge rollers 16 (16*a*, 16*b*) by further rotation of the platen roller 12. When image recording for one page is terminated, the recording sheet 11 is cut into a page unit by the meshing engagement between cutters 15 (15*a*, 15*b*) and the recording sheet is discharged.

The reference numeral 17 denotes an ink sheet supply roll on which the ink sheet 14 is wound, and the reference numeral 18 designates an ink sheet take-up roll which is driven by an ink sheet conveying motor which will be described later to thereby take up the ink sheet 14 in the direction of arrow a. The ink sheet supply roll 17 and the ink sheet take-up roll 18 are removably mounted in an ink sheet loading portion 70 within the apparatus body. The reference numeral 19 designates a sensor for detecting the remaining quantity of the ink sheet 14 and detecting the conveyance velocity of the ink sheet 14. The reference numeral 20 denotes an ink sheet sensor for detecting the presence or absence of the ink sheet 14. The reference numeral 21 designates a spring for urging the thermal head 13 against the platen roller 12 with the recording sheet 11 and the ink sheet 14 interposed therebetween. The reference numeral 22 denotes a recording sheet sensor for detecting the presence or absence of the recording sheet.

The construction of the reading unit 100 will now be described.

In FIG. 3A, the reference numeral 30 designates a light source for illuminating an original 32. The light reflected by the original 32 is input to a CCD sensor 31 through an optical system (mirrors 50, 51 and a lens 52) and converted into an electrical signal. The original 32 is conveyed correspondingly to the reading speed for the original 32 by conveying rollers 53, 54, 55 and 56 driven by an original conveying motor (not shown). The reference numeral 57 denotes an original supporting table. A plurality of originals 32 placed on the original supporting table 57 are separated one by one by the cooperation between a conveying roller 54 and a press-separating piece 58 while being guided by a slider 57*a*, and are conveyed to the reading unit 100.

The reference numeral 41 designates a control base plate constituting the essential portion of the control unit 101. Various control signals are output to various portions of the apparatus by this control base plate 41. The reference numeral 106 denotes a modem base plate unit, and the reference numeral 107 designates an NCU base plate unit.

FIG. 4 shows the details of conveying mechanisms for the ink sheet 14 and the recording sheet 11.

In FIG. 4, the reference numeral 24 denotes a recording sheet conveying motor for rotatively driving the platen roller 12 to thereby convey the recording sheet 11 in the direction of arrow b opposite to the direction of arrow a. The reference numeral 25 designates an ink sheet conveying motor for conveying the ink sheet 14 in the direction of arrow a with the aid of a capstan roller 71 and a pinch roller 72. The reference numerals 26 and 27 denote transmission gears for transmitting the rotation of the recording sheet conveying motor 24 to the platen roller 12, and the reference numerals 73 and 74 designate transmission gears for transmitting the rotation of the ink sheet conveying motor to the capstan roller 71. The reference numeral 75 denotes a slide clutch unit.

By setting the ratio between the gears 73 and 74 so that the length of the ink sheet 14 taken onto the take-up roll 18 by the rotation of a gear 75*a* may be greater than the length of the ink sheet conveyed by the capstan roller 71, the ink sheet 14 conveyed by the capstan roller 71 is reliably taken onto the take-up roll 18. An amount corresponding to the difference between the amount of the ink sheet 14 taken up by the take-up roll 18 and the amount of the ink sheet 14 conveyed by the capstan roller 71 is absorbed by the slide clutch unit 75. Thereby, the fluctuation of the conveyance velocity (amount) of the ink sheet 14 by the fluctuation of the take-up diameter of the take-up roll 18 can be suppressed.

As previously described, the directions of conveyance of the recording sheet 11 and the ink sheet 14 are made opposite to each other, whereby the direction in which images are successively recorded lengthwisely of the recording sheet 11 (the direction of arrow a, i.e., the direction opposite to the direction of conveyance of the recording sheet 11) and the direction of conveyance of the ink sheet 14 coincide with each other. Here, assuming that the conveyance velocity $V_P$ of the recording sheet 11 is $V_P = -n \cdot V_I$ ($V_I$ being the conveyance velocity of the ink sheet 14, and the sign indicating that the direction of conveyance of the recording sheet 11 and the direction of conveyance of the ink sheet 14 differs from each other), the relative velocity $V_{PI}$ of the recording sheet 11 and the ink sheet 14 relative to the thermal head 13 is expressed as $V_{PI} = V_P - V_I = (1 + 1/n) V_P$, and it will be seen that this relative velocity $V_{PI}$ is equal to or greater than $V_P$, that is, greater than the conventional relative velocity (incidentally, the conventional relative velocity $V_{PI} = V_P - V_I = V_P - V_{P/n} = (1 - 1/n)V_P$).

Besides this, there is a method of conveying the ink sheet 14 in the direction of arrow a by (l/m) (m being an integer, and n>m) for each (n/m) lines when recording is effected for n lines by the thermal head 13, or a method of conveying the ink sheet 14 in the opposite direction to and at the same velocity as the recording sheet 11 during recording when recording is effected for a distance corresponding to the length L, and rewinding the ink sheet 14 by $L \cdot (n-1)/n$ $(n>1)$ before the recording of the next predetermined amount. In any of these cases, the relative velocity when recording is effected with the ink sheet 14 stopped is $V_P$ and the relative velocity when recording is effected with the ink sheet 14 being moved is $2V_P$.

FIG. 1 shows electrical connections between the control unit 101 and the recording unit 102 in the facsimile apparatus of the present embodiment, and in FIG. 1, portions common to those in other figures are designated by identical reference numerals.

The thermal head 13 is a line head as previously mentioned. This thermal head 13 is provided with a shift register 130 for receiving as inputs the serial recording data for one line and shift clock 43 from the control unit 101, a shift register for receiving pre-heat data as an input, a latch circuit for latching the data of the shift register 130 and the data of a shift register 134 for pre-heat data by a true latch signal 44 and a pre-latch signal 44*a*, respectively, and a heat generating element 132 comprising a plurality of heat generating resistance members corresponding to one line. The heat generating element 132 is divided into m blocks designated by 132-1 to 132-m and is driven. The reference numeral 133 denotes a temperature sensor attached to the thermal head 13 for detecting the temperature of the thermal head 13. The output signal 42 of this temperature sensor 133 is A/D-converted in the control unit 101 and input to the CPU 113. Thereby the CPU 113 detects the temperature of the thermal head 13, and changes the pulse width of the strobe signal 47 or changes the driving voltage of the thermal head 13 correspondingly to the detected temperature, thereby changing the applied energy to the thermal head 13 in conformity with the characteristic of the ink sheet 14. The reference numeral 116 designates a programmable timer on which the count time is set by the CPU 113 and which starts counting time when it is instructed to start counting time. The timer 116 operates so as to output an interruption signal, a time-out signal, etc. to the CPU 113 at each instructed time.

The type (characteristic) of the ink sheet 14 may be automatically discriminated by the switch 103*a* of the aforedescribed operation unit 103, or by indicating a mark or the like printed on the ink sheet 14. Alternatively, the type of the ink sheet 14 may be automatically discriminated by detecting a mask, a cut-away or a projection formed on the cartridge of the ink sheet.

The reference numeral 46 denotes a driving circuit which receives as an input the driving signal for the thermal head 13 from the control unit 101 and outputs a strobe signal 47 for driving the thermal head 13 at each block unit. This driving circuit 46 can change the voltage output to a power source line 45 for supplying an electric current to the heat generating element 132 of the thermal head 13, in accordance with the instructions from the control unit 101, thereby changing the applied energy to the thermal head 13. The reference numeral 36 designates a driving circuit for bringing the cutters 15 into meshing engagement with each other and driving the same. The driving circuit 36 includes a cutter driving motor or the like. The reference numeral 39 denotes a sheet exhausting motor for rotatively driving the sheet discharge rollers 16. The reference numerals 35, 48 and 49 designate driver circuits for rotatively driving the corresponding sheet exhausting motor 39, recording sheet conveying motor 24 and ink sheet conveying motor 25. In this embodiment, the sheet exhausting motor 39, the recording sheet conveying motor 24 and the ink sheet conveying motor 25 are stepping motors. This is not restrictive; but they may be DC motors or the like.

Description of the Recording Operation (FIGS. 1-6)

FIGS. 5A and 5B are a flow chart showing the recording process for one page in the facsimile apparatus of this embodiment, and a program for executing this process is stored in the ROM 114 of the control unit 101.

It is to be understood that this process is started when image data for one line is stored in the line memory 110 and a state in which the recording operation can be started being brought about and that it is discriminated in the control unit 101 by the switch 103*a* or the like that the multi-ink sheet 14 is mounted.

The epitome of the control using the present embodiment will now be described here.

The present embodiment is such that if within a predetermined time and after the termination of the current recording, the transport of the data of the next line is terminated, pre-heating is not effected, but the phases of the motors for conveying the recording sheet and the ink sheet are changed, whereafter the recording of the next line is started after the lapse of the time until the motors start to move. Also, if after the termination of the current recording, the predetermined time a elapses and the transport of the data of the next line is terminated within a predetermined time b, the phases of the motors for conveying the recording sheet and the ink sheet are changed, whereafter data $\phi$ AAH and data $\phi$ 55H are alternately used as pre-heat data, whereby pre-heating is effected. The program waits for the time from after the pre-heating is terminated until the motors start to move (in the present embodiment, the waiting time is zero), and shift is made to the recording of the next line. Also, if the predetermined time b elapses after the termination of the main recording and the transport of the data of the next line is terminated, the phases of the motors for conveying the recording sheet and the ink sheet are changed, whereafter pre-heating is effected with all "1" (all black, i.e., all heat generating elements are caused to heat) as pre-heat data (in this case, energy smaller than energy for the main recording is applied to the head so that recording may not take place). Then, the program waits for the time from after the termination of this pre-heating until the motors start to move (in the present embodiment, the waiting time is zero), and shift is made to the recording of the next line.

In the present embodiment, the pre-heat data is changed depending on the time from after the termination of the main recording until the termination of the transport of the data of the next line. That is, when the time until the termination of the transport of the data of the next line is long, the black rate of the pre-heat data is enhanced. The pre-heat width is fixed.

In the present embodiment, when the time until the termination of the transport of the data of the next line is less than a predetermined time, pre-heating is not effected, and when said time is equal to or greater than a, and less than b, pre-heat data of black rate 50% is used, and when said time is equal to or greater than b, pre-heat data of black rate 100% is used. Here, the energy applied to each dot by pre-heating in the case of black rate 50% is made equal with data $\phi$AAH and $\phi$55H being repetitively used. That is, the pre-heat data rotates cyclically and the energy applied to each dot of the head by pre-heating is under the same control.

In the aforedescribed embodiment, the black rate has been considered to be 0%, 50% and 100%, but first control may be adopted.

Figure 6:
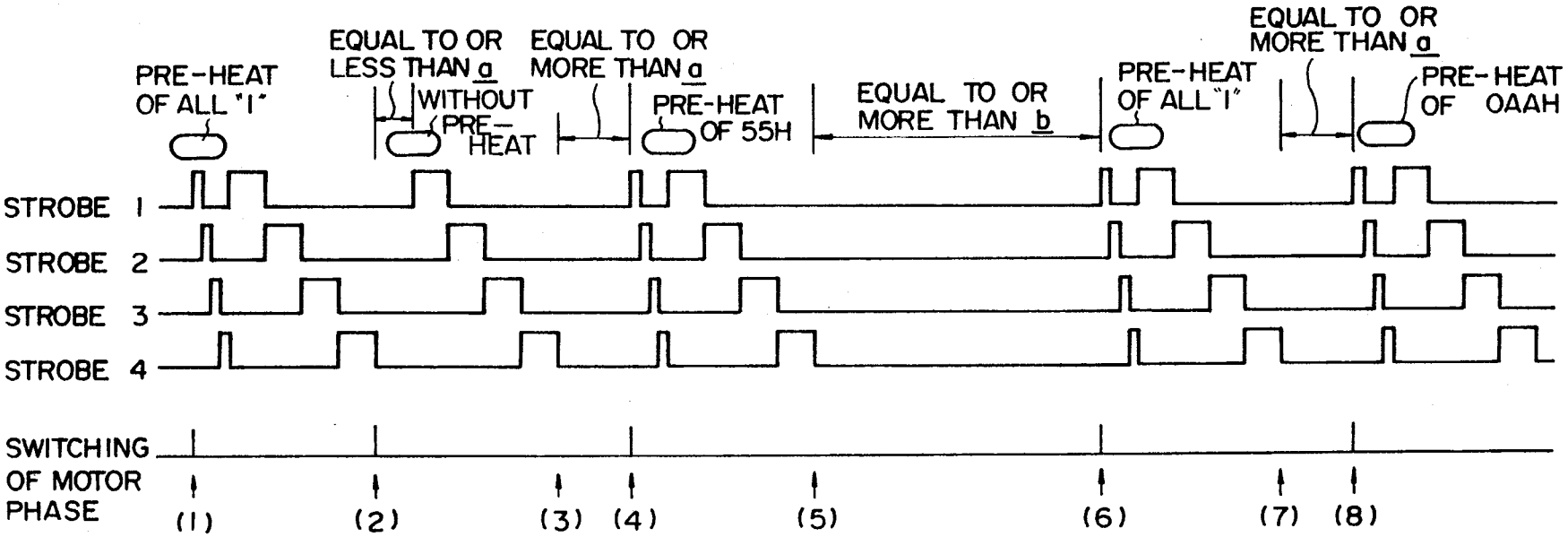
FIG. 6 shows the electrical energization timing for a thermal head in the recording process of the embodiment.

FIG. 6 shows the phase change of the motors and various strobe waveforms. First, at timing (1), the phase switching of the motors for the recording sheet and the ink sheet is effected. Then, pre-heat of all "1" is effected. Thereafter, at timing (2), the current recording is effected. At a point of time when the main recording has been terminated (timing (2)), the transport of the data of the next line is terminated (the time from after the termination of the main recording until the termination of the transport of the data of the next line is equal to or less than the predetermined time a) and therefore, the current recording is effected without pre-heat being effected. In a time less than b and equal to or more than the predetermined time a after the main recording has been terminated (timing (3)), the transport of the data of the next line is terminated (timing (4)) and therefore, here pre-heat is effected by data 55H and the main recording is effected. In a time equal to or more than the predetermined time b after the main recording has been terminated (timing (5)), the transport of the data of the next line is terminated (timing (6)) and therefore, here pre-heat is effected by data of all "1" (all black) and the main recording of the next line is effected. In a time less than b and equal to or greater than the predetermined time a after the main recording has been terminated (timing (7)), the transport of the data of the next line is terminated (timing (8)) and therefore, here pre-heating is effected by data AAH.

Although in the aforedescribed embodiment, the pre-heat data has been changed in conformity with the time from after the termination of the main recording until the termination of the transport of the data of the next line, the pre-heat data may be all "1", i.e., all black. Here, if the recording of the preceding line is effected as pre-heat data, sticking will be improved. An example of such control is shown in FIGS. 10A and 10B (in which, as compared with the flow chart of FIG. 5 to be described, steps S0, S15, S16 and S17-1 are eliminated). However, regarding the reproduction of the isolation point, an increase in the energy at the isolation point is necessary, because the information of the line preceding the isolation point is white and therefore it is not effective even if the preceding line is recorded as the pre-heat data. From these two points of view, it may be preferable to electrically energize and pre-heat all black information immediately before the current recording. The electrical energization of all black information is for keeping temperature, and the energy used therefor is non-recording energy. Also, during pre-heat, the recording sheet and the ink sheet are stationary and it is difficult for the ink to be transferred to the recording sheet.

Figure 9:
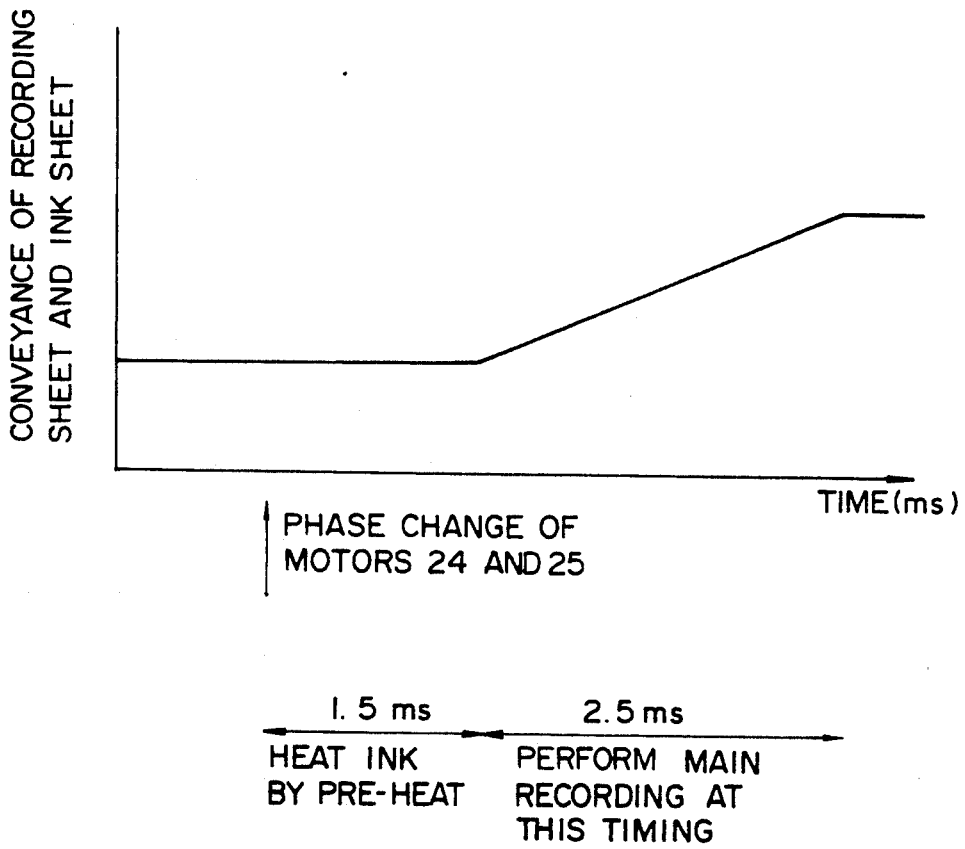
FIG. 9 shows the timing for the phase change of motors and the conveyance of the recording sheet and the ink sheet.

Now, according to the present embodiment, the main recording is effected at timing when the motors for conveying the recording sheet and the ink sheet, respectively, actually start to move after the phases of these motors are switched. So, according to the recording system of the present embodiment, melted (or sublimated depending on the kind of the ink) ink rubs against the recording sheet and is thereby transferred to the recording sheet and therefore, the ink can be transferred more efficiently by effecting move-writing (recording). If there is a predetermined or greater recording interval (e.g. 10 ms or more) after the switching of the motor phase has been effected, the thermal head 13 is caused to generate heat to thereby effect pre-heating, and in the meantime, the ink is heated and warmed. Then, from the timing at which the recording sheet and the ink sheet start to be moved, the main recording is effected to thereby accomplish efficient transfer. What has been described above is the epitome. FIG. 9 shows the phase switching of the motors, the conveyance of the recording sheet and the ink sheet, and the timing of the main recording. In the embodiment shown in FIG. 9, after the phase change of the motors 24 and 25, pre-heat is effected for 1.5 ms by the thermal head, whereafter the main recording for 2.5 ms is performed.

Now, as shown in FIGS. 5A and 5B, when at a stop S0, the time from after the termination of the main recording until the termination of the transport of the next line is less than b and equal to or more than the predetermined time a, data 134 used for pre-heating is stored in PPI-DATA. In the present embodiment, it is to be understood that the predetermined time a is 5 ms and the predetermined time b is 10 ms.

Subsequently, at a step S1, the recording data for one line is serially output to the shift register 130. When the transport of the recording data for one line is terminated, at a step S2, all "1" is transported to the shift register for pre-heat. At a step S3-1, a pre-latch signal 44*a* is output and pre-heat data 134 for one line is stored in the latch circuit 131. Subsequently, at a step S3-2, the ink sheet conveying motor 25 is driven to convey the ink sheet 14 by 1/n lines. At a step S3-3, the recording sheet 11 is conveyed by one line. In the facsimile apparatus of the present embodiment, the length of this one line is set to about 1/15.4 mm, and the amounts of conveyance of the recording sheet 11 and the ink sheet 14 can be set by changing the energization pulse numbers of the recording sheet conveying motor 24 and the ink sheet conveying motor 25, respectively. Next, at a step S3-4, the blocks of the heat generating resistance member 132 are electrically energized. It is to be understood that the energization time of each block is e.g. 0.2 ms. When the electrical energization of four blocks is terminated, advance is made to a step S4, where a true latch signal 44 is output and the recording data for one line is stored in the latch circuit 131.

Subsequently, at a step S5, one block of the heat generating resistance member 132 is electrically energized to thereby effect the recording of an image, and at a step S6, whether the electrical energization of all blocks of the thermal head 13 has been terminated is examined. If at the step S6, the electrical energization of all blocks of the thermal head 13 is not terminated, advance is made to a step S7, where whether the recording data for the next line has been prepared is examined. If the recording data for the next line is not prepared, advance is made to a step S8, where the recording data for the next line is successively transported to the shift register 130 of the thermal head 13. Whether the energization time of one block has passed during the data transport to the thermal head 13 is examined at a step S9. If the energization time (about 600 μs) has not passed, return is made to the step S7, but if the energization time has passed, return is made to the step S5, where the electrical energization of the next block is executed. In the present embodiment, the thermal head 13 is divided into four blocks and electrically energized, and the time required for the recording of one line is approximately 2.5 ms (600 μs×4 blocks).

If at the step s6, the electrical energization of all blocks is terminated and the recording of one line is terminated, advance is made to a step S10, where the timer 116 starts to count time. Advance is then made to a step S11, where whether the image recording for one page has been terminated is examined. If the image recording for one page is not terminated, advance is made to a step S12, where whether all the image data of the next line has been transported to the shift register of the thermal head 13 is examined. If said image data has not been transported, at a step S13, the data transporting process for transporting the data of the next line to the thermal head 13 if such data is prepared is executed.

If in this manner, at the step S12, the image data of one line to be next recorded is transported to the thermal head 13, advance is made to a step S14, where the timer 16 examines whether the predetermined time a has passed. If the predetermined time a has not passed, advance is made to a step S17-2, where the ink sheet conveying motor 25 is driven to convey the ink sheet 14 by 1/n lines. Then, at a step S17-3, the recording sheet 11 is conveyed by one line. At a step S17-4, the program waits until the motors 24 and 25 start to move, and at a step S17-5, the true latch signal 44 is output and recording data for one line is stored in the latch circuit 131.

However, when the predetermined time a has passed, advance is made to a step S15, where whether the predetermined time b has passed is determined. If the predetermined time b has passed, advance is made to the step S2, and if the predetermined time b has not passed, PRI-DATA is rotated by one bit (a step S16) and one line of the pattern of PRI-DATA is output as pre-heat data 134 (a step S17-1).

Subsequently, if at a step S11, image recording for one page is terminated, advance is made to a step S18, where the recording sheet 11 is conveyed toward the paper discharge rollers 16*a* and 16*b* by a predetermined amount. At a step S19, the cutters 15*a* and 15*b* are driven into meshing engagement with each other, whereby the recording sheet 11 is cut into a page unit. Subsequently, at a step S20, the recording sheet conveying motor 24 is driven reversely to return the recording sheet 11 by a distance corresponding to the spacing between the thermal head 13 and the cutters 15, and the cutting process for the recording sheet 11 is executed.

Thus, according to the present embodiment, the thermal head 13 is caused to generate heat after the lapse of a predetermined time after the phases of the ink sheet conveying motor 25 and the recording sheet conveying motor 24 are changed and therefore, the efficiency of the transfer of the ink to the recording sheet 11 is improved.

Figure 7:
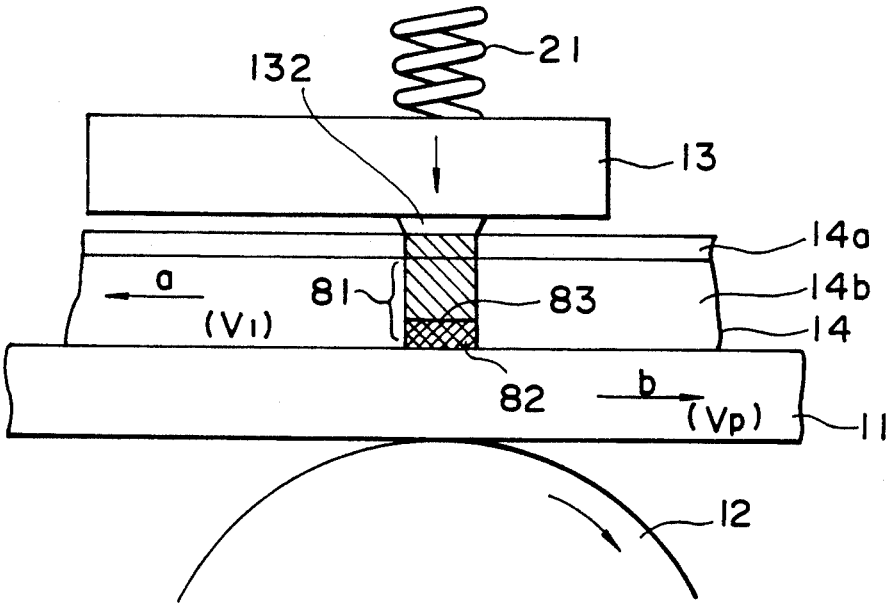
FIG. 7 shows the states of the recording sheet and the ink sheet during the recording in this embodiment.

Description of the Principle of Recording (FIG. 7)

FIG. 7 shows the image recording condition when recording of images is performed with the directions of conveyance of the recording sheet 11 and the ink sheet 14 in this embodiment being made opposite to each other.

As shown, the recording sheet 11 and the ink sheet 14 are nipped between the platen roller 12 and the thermal head 13, and the thermal head 13 is urged against the platen roller 12 with a predetermined pressure by a spring 21. The recording sheet 11 is conveyed at a velocity $V_P$ in the direction of arrow b by the rotation of the platen roller 12. On the other hand, the ink sheet 14 is conveyed at a velocity $V_1$ in the direction of arrow a by the ink sheet conveying motor 25.

Now, when heat generating resistance member 132 of the thermal head 13 is electrically energized by the power source 105 and heated, the portion of the ink sheet 14 which is indicated by hatching 81 is heated. Here, the reference character 14*a* designates the base film of the ink sheet 14, and the reference character 14*b* denotes the ink layer of the ink sheet 14. The ink of the ink layer 11 heated by the heat generating resistance member 132 being electrically energized is melted, and that portion thereof which is indicated by 82 is transferred to the recording sheet 11. This transferred ink layer portion 82 corresponds to approximately 1/n of the ink layer designated by 81.

During this transfer, it is necessary that a shearing force for the ink be produced at the border line 83 of the ink layer 14*b* and only the portion indicated by 82 be transferred to the recording sheet 11. However, this shearing force differs depending on the temperature of the ink layer, and tends to become smaller as the temperature of the ink layer becomes higher. So, if the heating time for the ink sheet 14 is shortened, the shearing force in the ink layer becomes greater and therefore, if the relative velocity of the ink sheet 14 and the recording sheet 11 is made greater, the ink layer to be transferred can be reliably peeled from the ink sheet 14.

According to this embodiment, the heating time for the thermal head 13 in the facsimile apparatus is as short as about 0.6 ms and therefore, by making the directions of conveyance of the ink sheet 14 and the recording sheet 11 opposite to each other, the relative velocity of the ink sheet 14 and the recording sheet 11 is increased.

Figure 8:
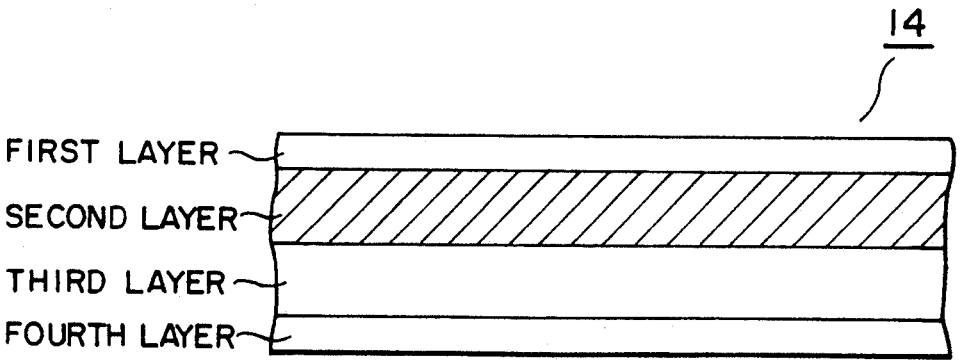
FIG. 8 is a cross-sectional view of a multi-ink sheet used in this embodiment.

Description of the Ink Sheet (FIG. 8)

FIG. 8 is a cross-sectional view of the ink sheet used in the multiprinting of the present embodiment, and as shown there, the ink sheet is comprised of four layers.

First, the second layer is base film which provides a support for the ink sheet 14. In the case of multiprinting, heat energy is applied to the same portion many times and therefore, the base film may advantageously be aromatic polyamide film of high heat resisting property or condenser paper, but conventional polyester film will may also be used. The thickness of this film may advantageously be as small as possible in respect of the quality of printing from its role as a medium, and may desirably be 3–8 μm from the viewpoint of strength.

The third layer is an ink layer containing therein an amount of ink transferable n times to the recording sheet. The chief components of this layer are resin such as EVA as an adhesive agent, carbon black or nigrosine dye for coloring, and carnauba wax or paraffin wax as a binding material, and these components are arranged so as to stand n times of use in the sample portion. The amount of application of these materials may desirably be 4–8 g/m$^2$, but can be chosen as desired because sensitivity and density differ depending on the amount of application.

The fourth layer is a top coating layer which is not involved with printing and which is for preventing the ink of the third layer from being pressure-transferred to the recording sheet, and is formed of transparent wax or the like. Thus, it is only the transparent fourth layer that is pressure-transferred, and the ground stain of the recording sheet can be prevented.

The first layer is a heat resisting coat layer for protecting the second layer, i.e., the base film, from the heat of the thermal head. This is suitable for multiprinting in which heat energy for n lines may be applied to the same portion (when black information is continuous), but whether it should be used or not can be suitably chosen. It is also effective for base film of relatively low heat resisting property such as polyester film.

The construction of the ink sheet 14 is not limited to this embodiment, but use may also be made of an ink sheet comprising, for example, a base layer and a porous ink retaining layer provided on one side of the base layer and containing ink therein, or an ink sheet comprising base film and a heat resisting ink layer provided on the base film and having fine porous net-like structure, the ink layer containing ink therein. Also, the material of the base film may be film formed, for example, of polyamide, polyethylene, polyester, polyvinyl chloride, triacetyl cellulose, nylon or the like, or paper. Further, the heat resisting coat layer is not always necessary, but the material thereof may be, for example, silicone resin, epoxy resin, fluorine resin, etholocellulose or the like.

Also, as an example of the ink sheet having heat-sublimating ink, mention may be made of an ink sheet comprising a base member formed of polyethylene terephthalate, polyethylene naphthalate, aromatic polyamide film or the like, and a color material layer provided on the base member and formed of guanamine resin and fluorine resin and containing spacer particles and dyestuff.

The heating system in the heat transfer printer is not limited to the aforedescribed thermal head system using a thermal head, but may be, for example, an electrical energization system or a laser transfer system.

Also, the present embodiment has been described as an example using a thermal line head, however, this is not restrictive. The present invention may be a so-called serial type heat transfer printer. Also, the present embodiment has been described with respect to the case of multiprinting, however, this is not restrictive; the present invention can also be applied to the ordinary heat transfer recording using a one-time ink sheet.

Further, this embodiment has been shown as being provided with an ink sheet conveying motor and a recording sheet conveying motor, however, the present invention is not restricted thereto, but may be made such that the ink sheet and the recording sheet are conveyed by the drive force of a single motor.

Furthermore, the above embodiment has been described with respect to a case where a heat transfer printer is applied to a facsimile apparatus, however, this is not restrictive; the present invention can also be applied, for example, to a word processor, a typewriter or a copying apparatus, besides a heat transfer recording apparatus.

The recording medium is not limited to recording paper, but may be, for example, cloth, a plastic sheet or the like if they permit the transfer of ink thereto. The ink sheet is not limited to the roll construction shown in the embodiment, but may be, for example, of the so-called ink sheet cassette type in which an ink sheet is contained in a housing removably mountable in the body of a recording apparatus and the housing is bodily mounted or dismounted with respect to the body of the recording apparatus.

As described above, according to this embodiment, in a heat transfer printer, there is a delay from after the phases of the recording sheet and ink sheet conveying motors are changed until the motors start to move, and therefore, during that time, the ink is heated and warmed and the main recording is performed from the timing at which the recording sheet and the ink sheet start to be moved, whereby it has become possible to accomplish efficient transfer.

Also, this embodiment is effective in a recording apparatus such as a facsimile apparatus in which the time interval between image data for one line may become non-uniform and lengthy.

As described above, according to the present invention, there can be provided a heat transfer recording apparatus and a facsimile apparatus which can record images of high quality.

We claim:

1. A thermal transfer recording apparatus for transferring an ink sheet to a recording medium to thereby effect recording of an image on said recording medium, comprising:

first conveying means for conveying said ink sheet;

second conveying means for conveying said recording medium;

a motor for driving at least one of said first conveying means and said second conveying means;

recording means for acting on said ink sheet to effect recording of said image on said recording medium;

time counting means for counting a time after a phase change of said motor; and control means for controlling said recording means so that said recording means is driven for recording after a lapse of said time after said phase change of said motor.

2. A thermal transfer recording apparatus according to claim 1, wherein when at least a predetermined recording interval has elapsed, said recording means is caused to generate heat to thereby effect pre-heating.

3. A thermal transfer recording apparatus according to claim 2, wherein said control means changes a pre-heating condition in response to a length of said recording interval.

4. A thermal transfer recording apparatus according to claim 1, further comprising:

receiving means for receiving a signal through an external communication line, said apparatus recording in response to said signal.

5. A thermal transfer recording apparatus for transferring an ink of an ink sheet to a recording medium to thereby effect recording of an image on said recording medium, comprising:

a first motor producing a drive force for conveying said ink sheet;

a second motor producing a drive force for conveying said recording medium;

recording means for acting on said ink sheet to effect recording of said image on said recording medium; and control means for controlling said recording means so as to be pre-heated as required when said recording means is caused to act on said ink sheet to effect recording of said image on said recording medium after a lapse of a time after a phase change of said first and said second motors, wherein said recording means is pre-heated, when necessary, after said phase change and before recording.

6. A thermal transfer recording apparatus according to claim 5, wherein a direction of conveyance of said ink sheet is opposite to a direction of conveyance of said recording medium.

7. A thermal transfer recording apparatus according to claim 5, wherein a length of conveyance of said ink sheet for recording is shorter than a length of conveyance of said recording medium.

8. A thermal transfer recording apparatus according to claim 5, wherein said recording medium is moved during heating of said recording means.

9. A thermal transfer recording apparatus according to claim 5, wherein said recording means further comprises a thermal head.

10. A thermal transfer recording apparatus according to claim 5, wherein said pre-heating is effected for all black data.

11. A thermal transfer recording apparatus according to claim 5, wherein said control means controls said recording means to generate heat to thereby effect pre-heating when at least a predetermined interval has elapsed.

12. A thermal transfer recording apparatus according to claim 11, wherein said control means changes a pre-heating condition in response to a length of a recording interval.

13. A thermal transfer recording apparatus according to claim 5, further comprising:

receiving means for receiving a signal through an external communication line, said apparatus recording in response to said signal.

14. A thermal transfer recording apparatus for transferring an ink of an ink sheet to a recording medium to thereby effect recording of an image on said recording medium, comprising:

a motor producing a drive force for conveying said ink sheet and said recording medium;

a recording means for acting on said ink sheet to effect recording of said image on said recording medium; and control means for controlling said recording means so as to be pre-heated in conformity with a condition when said recording means is caused to act on said ink sheet to effect recording of said image on said recording medium after a lapse of a time after a phase change of said motor, wherein said recording means is pre-heated, when necessary, after said phase change and before recording.

15. A thermal transfer recording apparatus according to claim 14, further comprising:

receiving means for receiving a signal through an external communication line, said apparatus recording in response to said signal.

16. A thermal transfer recording method for recording by transferring an ink of an ink sheet onto a recording medium, said method comprising the steps of:

switching a plurality of phases of a motor for conveying said ink sheet and said recording medium prior to a recording operation of a recording means for acting on said ink sheet to effect recording of an image on said recording medium; and recording by activating said recording means after a predetermined time has elapsed after switching said phase of said motor.

17. A thermal transfer recording method according to claim 16, further comprising the step of performing pre-heating when a recording interval is greater than the predetermined time prior to the recording by said recording means.

18. A thermal transfer recording method according to claim 17, wherein a condition of said pre-heating is changed in response to a length of said recording interval.

* * * * *

UNITED STATES PATENT AND TRADEMARK OFFICE

CERTIFICATE OF CORRECTION

PATENT NO. : 5,231,421

DATED : July 27, 1993

INVENTOR(S) : TAKEHIRO YOSHIDA, ET AL.

It is certified that error appears in the above-identified patent and that said Letters Patent is hereby corrected as shown below:

COLUMN 2

Line 59, "taken" should be deleted.

COLUMN 6

Line 62, "but" should be deleted.

COLUMN 10

Line 66, "layer 11" should read --layer 81--.

COLUMN 13

Line 5, "ink" should read --ink of an ink--.

COLUMN 14

Line 54, "phase" should read --phases--.

Signed and Sealed this

Twenty-sixth Day of April, 1994

Bruce Lehman

*Attest:*

BRUCE LEHMAN

*Attesting Officer*

*Commissioner of Patents and Trademarks*

--